US005768946A

United States Patent [19]

Fromer et al.

[11] Patent Number: 5,768,946

[45] Date of Patent: Jun. 23, 1998

[54] PEDAL WITH INTEGRATED POSITION SENSOR

[75] Inventors: Eric E. Fromer; Danny L. Koester, both of Elkhart, Ind.

[73] Assignee: CTS Corporation, Elkhart, Ind.

[21] Appl. No.: 712,039

[22] Filed: Sep. 11, 1996

Related U.S. Application Data

[63] Continuation-in-part of Ser. No. 321,195, Oct. 11, 1994, abandoned.

[51] Int. Cl.[6] ..... G05G 1/14

[52] U.S. Cl. ..... 74/514; 74/560

[58] Field of Search ..... 74/560, 514, 513, 74/512

[56] References Cited

U.S. PATENT DOCUMENTS

| | | | |
|---|---|---|---|
| 3,398,817 | 8/1968 | Shinga | 74/513 X |
| 4,057,130 | 11/1977 | Robertson | 74/513 X |
| 4,528,590 | 7/1985 | Bisacquino et al. | 74/513 X |
| 4,958,607 | 9/1990 | Lundberg | 74/560 X |
| 5,385,068 | 1/1995 | White et al. | 74/560 X |
| 5,408,899 | 4/1995 | Stewart | 74/514 X |
| 5,416,295 | 5/1995 | White et al. | 74/560 X |

*Primary Examiner*—Khoi Q. Ta
*Assistant Examiner*—Mary Ann Battista
*Attorney, Agent, or Firm*—Michael W. Starkweather; Albert W. Watkins

[57] ABSTRACT

A position sensor is nested into a cup-shaped portion of a molded pedal. The pedal directly drives the position sensor rotor, but the sensor is fully self contained and environmentally sealed. By nesting the sensor within the pedal, assembly is simplified and alignment of components is easily ensured. Additionally, the pedal still retains sufficient width to be designed to have adequate strength. The pedal structure may then be assembled easily and with few pieces, while still ensuring the proper functioning and internal alignment of the sensor.

8 Claims, 4 Drawing Sheets

PEDAL WITH INTEGRATED POSITION SENSOR

CROSS REFERENCE TO RELATED APPLICATIONS

This application is a continuation-in-part of U.S. application Ser. No. 08/321,195 filed Oct. 11, 1994 entitled "Pedal with Integrated Position Sensor" now abandoned.

BACKGROUND OF THE INVENTION

1. Field of the Invention

This invention pertains generally to pedals and more specifically to pedal structures cooperatively mated with electrical devices such as position sensors.

2. Description of the Related Art

In the control of motors and machinery there are a number of man-machine interfaces that have been proposed through the years. These interfaces have sought to ease man's ability to perform the functions required in the operation of the machines with as little extraneous action and hardware as possible. In this way, an operator may perform as many functions as possible with minimal hinderance and with maximum control. That way, safety and efficiency are at a maximum.

One way of controlling a machine is with the use of pedals. These pedals allow input to the machine by use of an operator's foot, while simultaneously keeping hands free for other typically more complex tasks. These pedals are found in a variety of machines including pianos, sewing machines, and motive equipment such as automobiles and trucks.

The pedals used to control these devices in some cases are mechanical, typically incorporating a cable or various gears and other transmission devices to convert the limited rotary motion available from the pedal into useful mechanical motion to control the machine. Other pedals incorporate some type of position sensor that converts the mechanical position into an electrical signal. In the field of locomotion, particularly pertaining to automobiles and trucks, a mechanical bracket using a cable, often referred to as a Bowden cable, is the standard method for controlling the throttle of internal combustion engines. These pedal assemblies have a desirable feel and functionality and, with a few refinements, are extremely reliable. This type of pedal assembly defines the mechanical standard today.

As noted, through time there have been a number of attempts at different types of pedal devices to control machines. One major attempt has been to introduce an electrical linkage between the pedal and the device to be controlled. An electrical linkage is desirable since gear assemblies are bulky, expensive and limited due to their inherent size to those applications where the pedal is very close to the controlled device. Gear and other mechanical linkages are also prone to sticking or binding. While the Bowden cable has proved generally reliable, the penetration of moisture and other contaminants may still cause the cable to bind or freeze up during inclement weather.

One early attempt at an electrical throttle controller is illustrated in U.S. Pat. No. 2,192,714. Therein, the throttle valve of an internal combustion engine could be controlled either by foot using a pedal or by hand using a knob. A second construction, illustrated for use with a forklift, is disclosed in U.S. Pat. No. 4,047,145. This second construction offers an ability to adjust the device for variances in manufacturing and performance among various assemblies.

A potentiometer is often used to sense the position of the accelerator pedal. This potentiometer is in some ways similar to the volume controls used in radio and television receivers. A voltage is applied across two extreme ends of a resistor. An intermediate tap is provided between the two extremes of the resistor. The tap is mechanically linked to the device which is to be sensed, and the position of the device is determined by the voltage at the intermediate tap.

There are several stringent requirements placed upon a pedal position sensor that make it different from a volume control. Since the pedal is used to measure a demand for power, binding of the pedal shaft in a position demanding power could result in life threatening situations. Safety and reliability are essential in automotive pedal applications.

The automotive environmental requirements are also different from a radio or television receiver. The pedal position sensor must reside in a dirty environment with widely varying temperatures. An operator may often bring large amounts of dirt or mud into the pedal region. Temperatures might, for example, range from −55 to +150 degrees Celsius. Further, the device may be exposed to a number of solvents and other adverse conditions associated with automotive environments. These requirements diverge greatly from the typical volume control.

In the prior art, levers or special mechanical drives were used to interface the electrical position sensor to the pedal. These drives ensured that, even in the event of some sensor malfunction, the pedal sensor would not retain the pedal in an acceleration position, but instead would allow the pedal to return to an idle stop. Engagement between the sensor and the pedal shaft then necessitated the use of a return spring so that as the pedal shaft returned to idle position, the pedal position sensor would also follow and track the position of the pedal.

The pedal position sensor in the prior art is a free-standing, rather self-contained device. In addition to the return spring, a well-sealed package including the associated bearings is typically provided. Significant effort was directed at designing a package that was sealed against the adverse chemicals, dirt and moisture that might otherwise damage the sensor.

Inclusion of the spring and bearings into this sealed package has drawbacks. The use of springs requires a fairly robust design. Springs and bearings add expense to the device and increase the cost and hazards of assembly. Additionally, any wear debris that may result from the spring or bearings may be detrimental to the operation of the position sensor. However, without these springs and bearings, there is little control over the element contactor interface, which has been determined to be very important for the life of the unit.

Variations in contact pressure, contact orientation, lube and other similar factors all impact the performance of the device. Further, field replacement is important for service repair, and the service replacement should be of the same quality as the original device. Failure to fully and completely package the sensor results in loss of precise control over lube thickness and composition, lost protection of vital components while shelved awaiting installation and during installation, and lost control over contactor and element relationships that are all desirable features.

Attempts at incorporating an electrical sensor into a pedal structure have in the past focussed on attachment of the sensor off to the side of the pedal, co-axial and often driven by the pivot shaft of the pedal. These designs were easy to implement with existing sensor designs and with very minimal modification to the pedal assembly. This kept tooling costs at a minimum and allowed maximum versatility, while still ensuring the safety of the complete system.

The use of a side mounted sensor has some drawbacks however. The sensor will typically carry therewith a bearing system or structure which might interfere with the pedal bearing system, particularly where the sensor and the pedal are not exactly co-axial. Additionally, the combined structure is somewhat bulkier than the pedal assembly, thereby ineffectively utilizing space. Some of the most current designs are also requiring smaller, more tightly integrated designs that are impossible to achieve with discrete pedal and sensor. This smaller size presents a challenge particularly in the case of the duplicated bearings and return springs.

With electronics becoming more prevalent and reliable than the mechanical counterparts, the ability to sense various engine functions and also in some instances non-engine or indirect engine functions is most desirable. The present invention seeks to overcome the limitations of the prior art sensors and offer an integrated pedal and position sensor that delivers unmatched performance without compromise and with outstanding value to cost ratio. Further, while the preferred embodiment is certainly accelerator pedal position sensing, the inventive features are applicable to position sensors in other applications, including but not limited to throttle, brake and other pedal position sensing, machine and industrial robot position sensing, and other applications for potentiometric devices of high quality and reliability.

SUMMARY OF THE INVENTION

The present invention overcomes the limitations of the prior art by nesting a position sensor into a cup-shaped portion of a molded pedal. The pedal directly drives the position sensor rotor, but the sensor is fully self contained and environmentally isolated. The invention also contemplates a method of assembly whereby nesting the sensor within the pedal simplifies assembly, and alignment of components is easily ensured. The pedal still retains sufficient width to be designed to have adequate strength. The pedal structure may then be assembled easily and without duplication of function between pedal and sensor, while ensuring the proper functioning and internal alignment of the sensor.

DESCRIPTION OF THE PREFERRED EMBODIMENT

Figure 1:
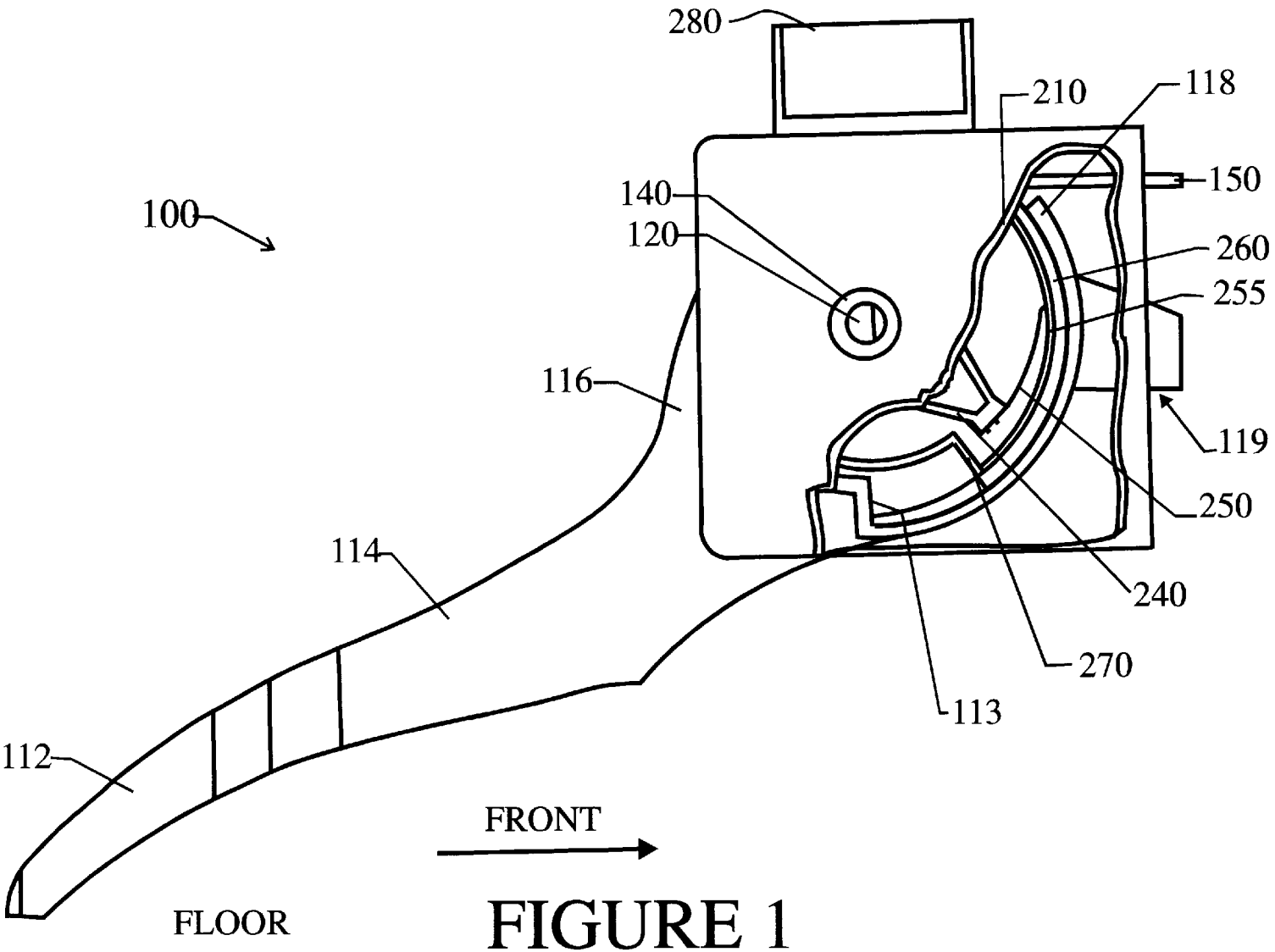
FIG. 1 illustrates a preferred embodiment pedal having an integrated sensor from a side view and having a small cut-away window exposing a portion of the integral position sensor.
Figure 2:
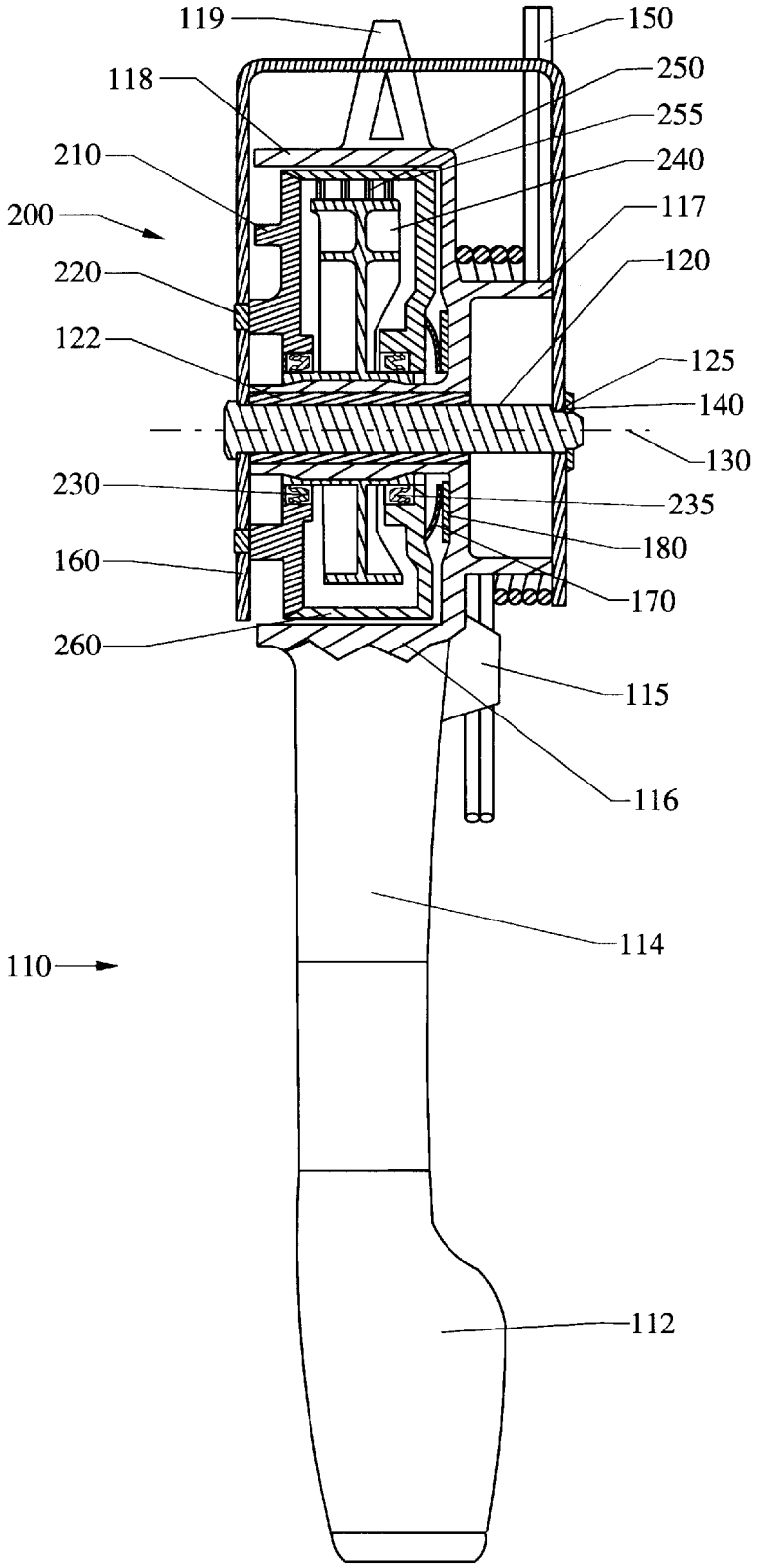
FIG. 2 illustrates the preferred embodiment pedal of FIG. 1 from a front view having the pedal bracket and sensor cut away to reveal the pedal and sensor internal structures.

A preferred embodiment of the invention is shown in FIGS. 1 and 2. A pedal assembly, generally identified by the numeral 100, includes a pedal 110 having a pedal foot pad 112 and a pedal arm 114. Extending from pedal arm 114 slightly is a small extension 115 designed to interact with return springs 150, so that when no pressure is applied to foot pad 112, pedal stop 119 is pressed against pedal bracket 160 thereby maintaining pedal foot pad 112 some finite distance off of the floor of the vehicle.

A large cup shaped pedal pivot section 118 extends away from flared pedal portion 116. Through the center part of cup shaped pedal pivot section 118 is pivot rod 120. Pivot rod 120 is a generally round rod having a flat 125 at one end. Flat 125 engages a half-moon or "D" shaped opening in bracket 160 to prevent relative rotation between rod 120 and bracket 160. Terminating rod 120 may be an e-ring, c-clip or similar retaining device 140. Where more permanent connection is desired, rod 120 may be swaged or otherwise deformed to enlarge the end regions thereof.

Between rod 120 and cup shaped pedal pivot section 118 is a sleeve 122 of a slippery material such as those having TEFLON®-like properties. While the invention may be practiced without sleeve 122, the inclusion of sleeve 122 allows greater flexibility in the selection of materials for pedal 110.

Pedal pivot section 118 does, in cross-section as shown in FIG. 2, resemble two "U" shaped troughs that are adjacent the pivot rod 120. This forms a cup shaped region into which a doughnut shaped position sensor 200 having a cover 210, housing 260 and rotor 240 may be inserted. The position sensor 200 is placed into pedal 110 within cup shaped pedal pivot section 118 and the now combined pedal and position sensor are slipped into pedal bracket 160. The cover 210 of position sensor 200 is designed to have features 220 which interact with pedal bracket 160, to both guide pedal 11O and sensor 200 into proper alignment with bracket 160 and also to positionally retain them once so placed. A preferred form of features 220 is a set of small parallel tracks which can directly engage bracket 160 along parallel axes, thereby allowing for insertion along a single axis, and thereby also preventing rotation therebetween. Also, section 118 has an opening therein which allows electrical connector 280 of sensor 200 to protrude.

Pedal 110 has a second cup shaped portion 117 which opens in a direction opposite cup shaped portion 118. Cup shaped portion 117 serves as a wrapping point for return spring or springs 150, while the combination of the exterior of cup 118 and the interior wall of bracket 160 serve to form a small chamber for return springs 150. This chamber is notably isolated from the inner portion of cup 118, further helping to protect sensor 200 from any debris which return springs 150 might generate or throw about. Return springs 150 near an end thereof are anchored in bracket 160.

Pedal 110 rotates about rotational axis 130, centered within pivot rod 120, while position sensor housing 260 remains stationary. Between pedal 110 and housing 260 are a friction plate 180 and wave washer 170 which interact to form a mechanical drag. This mechanical drag emulates the Bowden cable friction, and the associated delay in pedal return after an operator releases the pedal.

While position sensor housing 260 remains stationary, rotor 240 must rotate with pedal 110. This is achieved through the use of a splined or cogged shaft, or through the use of a flat or "D" shaped section on the center part of cup shaped pedal pivot section 118. The drive feature will engage a similar feature found on rotor 240, as is well understood for each of these features.

In some instances, it may be desirable to incorporate a small amount of mechanical hysteresis, such that ordinary vibration is not translated into changes in demand for power. In those instances, the drive mechanism on the pedal pivot section 118 may be made to be slightly smaller than the mating surface(s) on rotor 240. By proper design, a predetermined amount of hysteresis may be incorporated into the drive between pedal 110 and rotor 240. Carried upon rotor 240 are the usual set of contactors 250 found in prior art potentiometric sensors. These contactors 250 electrically engage with a prior art type resistive element 255 which is placed around the inside of the exterior wall of housing 260. Electrical connection to resistive element 255 may be achieved through electrical connector 280, as is also well known in the prior art.

At one extreme of travel, where no pressure is applied, pedal stop 119 stops pedal 110 against bracket 160. At the other extreme, which would correspond to full throttle, either the floor board or pedal stop 119 could act as the travel limit, or, alternatively, pedal face 113 might engage with sensor housing stop 270. In the presently preferred embodiment, pedal face 113 serves to protect against over-rotation of sensor 200 prior to installation in bracket 160. After installation and prior to the pedal assembly being installed in a vehicle, pedal stop 119 will prevent over-rotation. After 10 installation in a vehicle, the floor will preferably prevent over-rotation.

Rotor 240 is sealed relative to housing 260 and cover 210 through the use of two small seals 230, 235. In assembly, the seal nested against housing 260 is first placed, and then rotor 240 placed. Any friction between seal 235 and housing 260 only serves to press seal 235 into place. Cover 210 is pressed onto housing 260 and rotor 240 with seal 230 placed therebetween. Once again, any friction between seal 230 and cover 210 only serves to better place seal 230 against rotor 240 and cover 210.

Bracket 160 may then include protrusions, flanges, bolt holes or other similar means known in the art (not shown in FIGS. 1, 2 and 4) for attaching the resultant combined pedal structure to the vehicle's supporting structure, such as the bulkhead.

Figure 3:
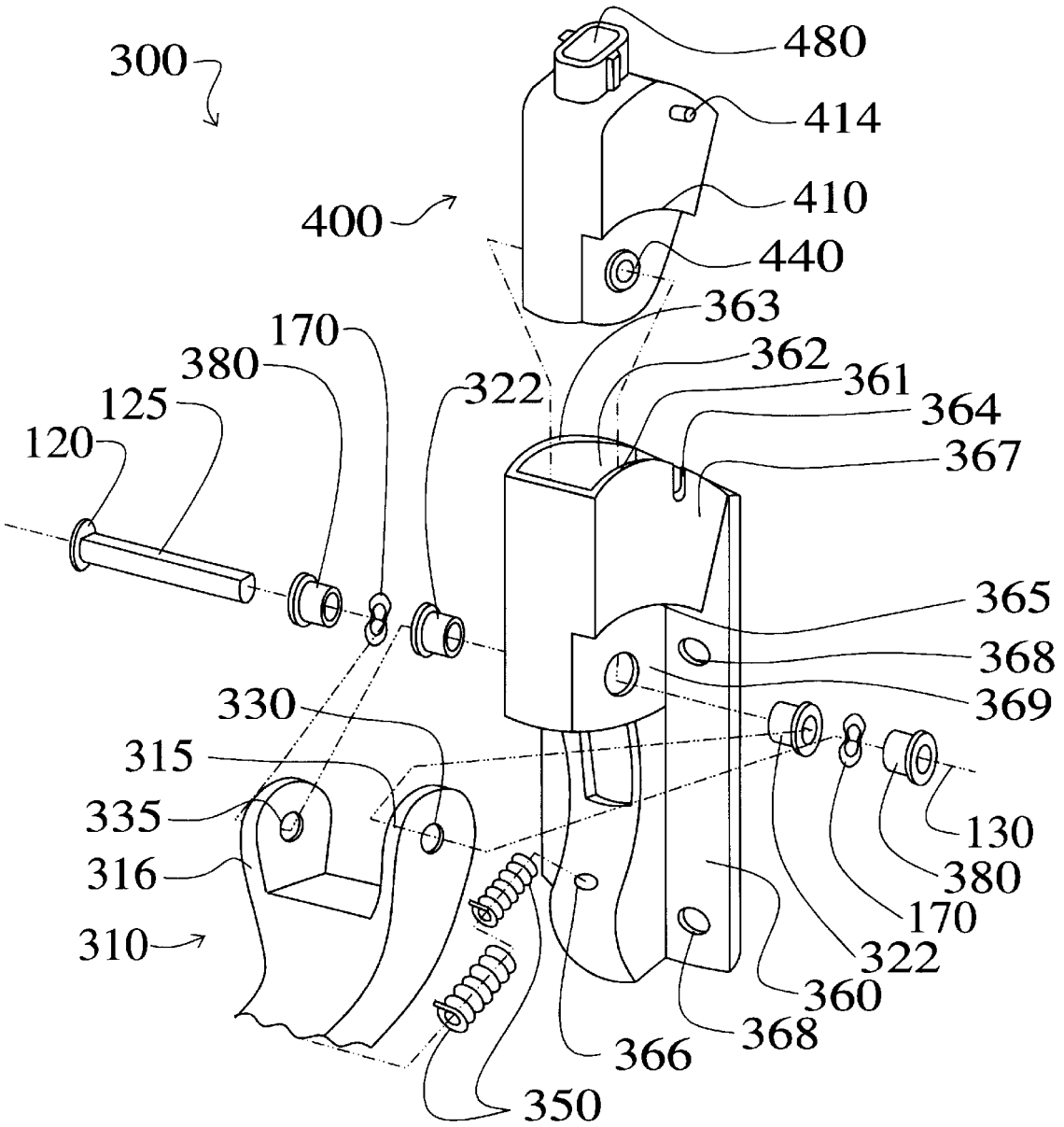
FIG. 3 illustrates an alternative embodiment pedal having an integrated sensor from an exploded perspective view.
Figure 4:
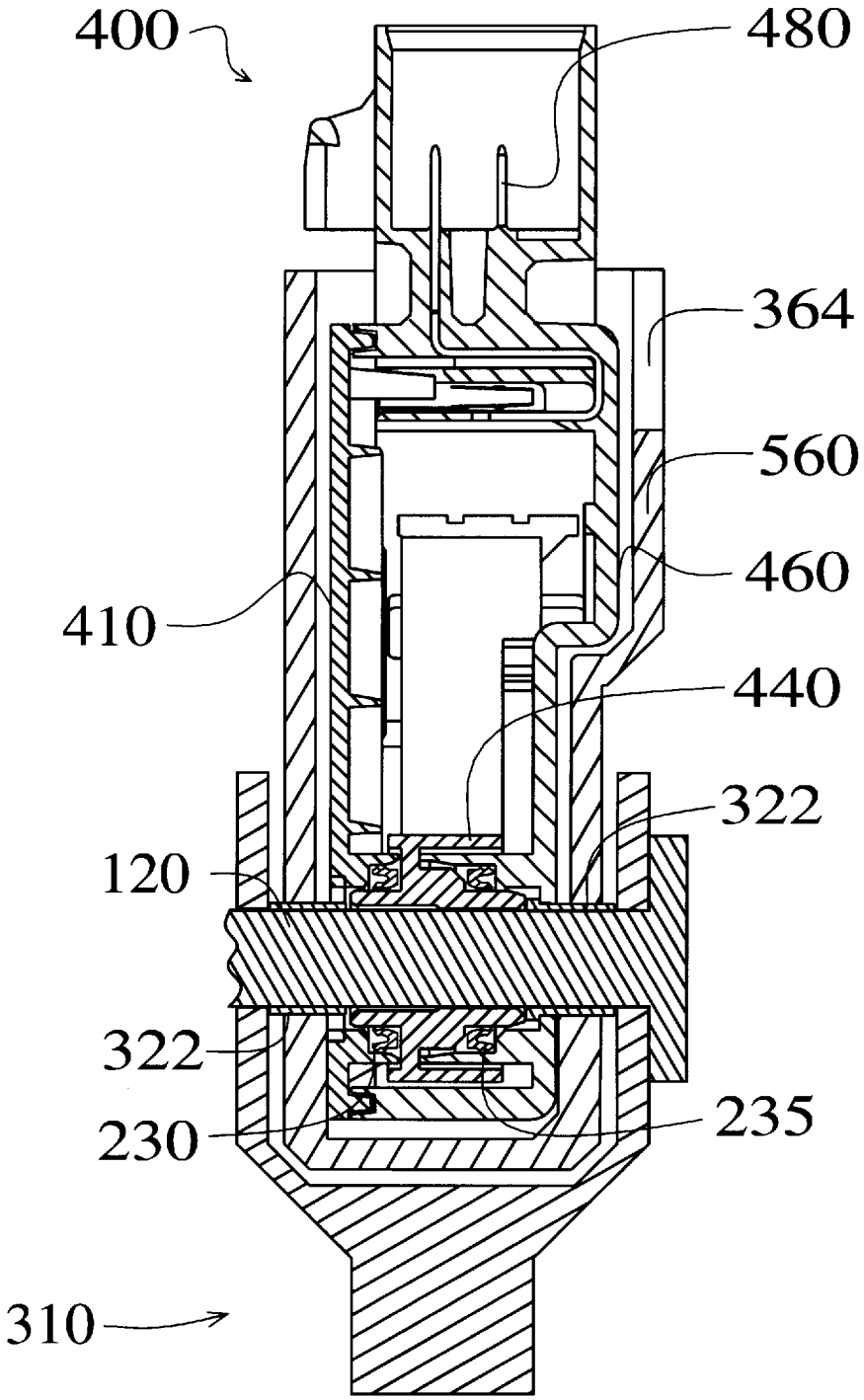
FIG. 4 illustrates the alternative pedal of FIG. 3 with additional variations from a crosssection view.

The alternative embodiment pedal assembly 300 of FIGS. 3 and 4 illustrates an alternative bracket assembly 360 having mounting holes 368. Bracket 360 additionally includes locator slot 364, cup shaped sensor pocket 362, return spring support pin 366 and arcuate pedal cut-away 365. Cup shaped sensor pocket 362 has a first wall 361 and a second wall 363. The first wall 361 further has a first wall section 367 and a second wall section 369. Second wall section 369 is spaced closer to second wall 363 than first wall section 367, thereby conserving space and allowing pedal 310 to be attached flush with first wall section 367.

Alternative position sensor 400 is rotationally driven about axis 130 by pivot rod 120 having flat 125 thereon. As with pedal assembly 100, from FIGS. 1 and 2 depressing alternative pedal 310 causes rotation of pivot rod 120 about axis 130. Sleeves 322 cooperate with wave washers 170 and friction sleeves 380 to provide drag similar to pedal assembly 100. Sensor 400 includes rotor 440 having pivot rod 120 passing therethrough, and also includes electrical connector 480. Cover 410 is shaped to match cup shaped sensor pocket 362, and includes locator pin 414 extending therefrom. Locator pin 414 engages locator slot 364 to fix cover 410 and housing 460 against rotation relative to bracket 360. Return springs 350 are shown in FIG. 3 as compression springs. Springs 350 may be placed at any appropriate place between bracket 360 and pedal 310. However, a small return spring support pin 366 provides a suitable locator for springs 350. Most preferably, one spring is larger in diameter than the other so that they may be arranged concentrically on pin 366. Two springs are preferred, to ensure that failure of one spring will not result in an undesirable wide open throttle condition. As long as sufficient clearance is provided between the outer diameter of the smaller spring and the inner diameter of the larger spring, and the two springs 350 are sufficiently close to pivot axis 130 to avoid large percentages of compression, the two will not interfere with each other.

Alternative pedal 310 has a right pedal yoke piece 315 having a hole 330 passing therethrough through which pivot rod 120 passes. Similarly, left pedal yoke piece 316 includes hole 335. Pedal 310 might be formed from molded plastic. The use of yoke pieces 315 and 316 provides maximum strength and torsional stability, by offsetting holes 330 and 335 as far as possible in a minimum space. The resulting pedal assembly 300 provides maximum performance from molded components in a minimum space. The available space in modem fuel efficient vehicles is ever-decreasing, so for those applications where molded components are desirable in limited space, this alternative pedal 310 may be more attractive than pedal assembly 100 from FIGS 1 and 2.

Additionally, assembly and inventory are both simplified by this alternative pedal 310. At the time of production assembly, sensor 400 may be inserted into bracket 360, and sleeves 322 inserted therein. Sleeves 322 serve to retain and locate sensor 400 within bracket 360, so that pedal 310 may be attached later, perhaps even by the customer. Since different vehicles require different pedal geometries, a minimum inventory will be required to build and service a wide range of pedal designs. The sensor and bracket combination may be inventoried, and then each different type of pedal separately inventoried, as opposed to, in the prior art, inventories of completed assemblies for each different pedal type. As a result, at the time of production one production line for the sensor and bracket could be used to service a large assortment of pedal styles. The use of a single production line increases volume for that design and thereby helps to lower cost.

FIG. 4 illustrates a slight variation of the FIG. 3 pedal assembly by cross-section. FIG. 3 includes two wave washers 170 and two friction sleeves 380. In FIG. 4, right side wave washer 170 and friction sleeve 380 are not used. Additionally, FIG. 4 illustrates second alternative bracket 560, which is similar to bracket 360, but without mounting holes 368 and the flange surrounding holes 368.

While the foregoing details what is felt to be the preferred embodiment of the invention, no material limitations to the scope of the claimed invention is intended. Further, features and design alternatives that would be obvious to one of ordinary skill in the art are considered to be incorporated herein. The scope of the invention is set forth and particularly described in the claims hereinbelow.

We claim:

1. A pedal assembly containing a position sensor, comprising:

a) a pedal having a pad at one end and a yoke at an opposite end, the yoke including first and second tabs;

b) a bracket having a pocket with first and second walls forming opposite and generally parallel sides of the pocket, where the first wall has generally parallel first and second wall sections, where the second wall section is spaced closer to the second wall than the first wall section, the bracket positioned between the first and second tabs so the first tab abuts the second wall section; and c) the position sensor, positioned within the pocket, for sensing the position of the pedal as the pedal is rotated relative to the position sensor.

2. The pedal assembly of claim 1, further comprising:

a pivot rod, extending through the first and second tabs, the second wall, the second wall section, and the position sensor, for forming a rotational axis of the pedal and moving the position sensor relative to the rotation of the pedal.

3. The pedal assembly of claim 1, wherein an outer surface of the first tab does not extend out further than an outer surface of the first wall section.

4. The pedal assembly of claim 1, further comprising:

resilience means, coupled between the bracket and the pedal, for forcing the pedal away from the bracket.

5. A pedal assembly containing a position sensor, comprising:

a) a pedal having a pad and a yoke at opposite ends, the yoke including a pair of parallel and oppositely facing tabs;

b) a pocket with at least one pair of parallel and oppositely facing sides positioned and dimentioned for the tabs to be adjacent to outside surfaces of the respective sides; and c) the position sensor, positioned adjacent and between inside surfaces of the sides, and being coupled to the yoke, for sensing a rotational position of the pedal relative to the position sensor.

6. The pedal assembly of claim 5, further comprising a pivot rod that is positioned and dimensioned to fit through the pair of tabs, the pair of sides, and the position sensor.

7. The pedal assembly of claim 6, wherein one side of the pocket has generally parallel first and second wall sections, where the second wall section is spaced closer to the other side of the pocket than the first wall section, the pocket positioned so one of the tabs abuts only the second wall section.

8. The pedal assembly of claim 7, further comprising a resilient device, coupled between the pocket and the pedal, for rotationally forcing the pedal generally toward a starting neutral position.

* * * * *